US008905853B2

(12) United States Patent
Ruffino et al.

(10) Patent No.: US 8,905,853 B2
(45) Date of Patent: Dec. 9, 2014

(54) SYSTEM AND METHOD FOR A PORTABLE ICE SKATING RINK

(71) Applicants: Brian Ruffino, Buffalo, NY (US); Joseph Pinelli, Springville, NY (US)

(72) Inventors: Brian Ruffino, Buffalo, NY (US); Joseph Pinelli, Springville, NY (US)

( * ) Notice: Subject to any disclaimer, the term of this patent is extended or adjusted under 35 U.S.C. 154(b) by 79 days.

(21) Appl. No.: 13/743,538

(22) Filed: Jan. 17, 2013

(65) Prior Publication Data

US 2014/0196492 A1 Jul. 17, 2014

(51) Int. Cl.
*A63C 19/10* (2006.01)
*F25C 3/02* (2006.01)

(52) U.S. Cl.
CPC ..... *F25C 3/02* (2013.01)
USPC ..... 472/90; 62/235

(58) Field of Classification Search
USPC ..... 472/88, 90, 91, 92, 94; 4/494, 506; 62/235
See application file for complete search history.

(56) References Cited

U.S. PATENT DOCUMENTS

| | | | | | |
|---|---|---|---|---|---|
| 2,996,896 | A | * | 8/1961 | Johnson | 62/235 |
| 3,797,049 | A | * | 3/1974 | De Santo | 62/235 |
| 3,933,002 | A | * | 1/1976 | Vickery | 62/56 |
| 4,815,301 | A | | 3/1989 | Deloughery | |
| 5,669,227 | A | * | 9/1997 | Morris | 62/235 |
| 5,820,470 | A | * | 10/1998 | Saunders | 472/92 |
| 6,327,864 | B1 | * | 12/2001 | Crowe | 62/66 |
| 6,517,442 | B1 | | 2/2003 | Post | |

* cited by examiner

*Primary Examiner* — Kien Nguyen
(74) *Attorney, Agent, or Firm* — Vincent G. LoTempio; Kloss, Stenger & LoTempio; David Stephenson

(57) ABSTRACT

A portable ice skating rink comprising, a flexible rubber sheet having a first end and a second end wherein the first end is connected to the second end thereby forming a sidewall, wherein the sidewall is positioned on a horizontal surface to form the border of a closed geometric shape thereby defining a skating surface area, and a flexible, water-proof slip draped over and connected to the sidewalls, thereby forming a liner of a structure capable of containing a liquid inward of the sidewalls to create a skating surface.

19 Claims, 4 Drawing Sheets

SYSTEM AND METHOD FOR A PORTABLE ICE SKATING RINK

FIELD OF THE DISCLOSURE

The present disclosure relates generally to privately used home and yard ice rinks for skating and other purposes, and more particularly ice rinks, which are portable that can be easily assembled and disassembled.

BACKGROUND

Ice skating is a popular recreational activity, and there are many variations of activities that can be engaged in on ice skating rinks. The primary activities engaged in on ice skating rinks are recreational ice skating, the games of hockey, curling, figuring skating, and ice dancing. At one time, these activities were performed on "home" ice skating rinks, which primarily took place on frozen ponds, streams, and other naturally occurring bodies of water. With each of these "home" rinks, there is a real and ever present danger, especially with young children, of death by drowning and/or overexposure upon falling through ice, which is too thin to bear the load, applied. In order to eliminate the danger of "home" ice skating rinks, public ice skating rinks started being developed along with shallow portable ice skating rinks.

Issues soon arose with the public ice skating rinks as they typically require that a person go to a nearby public ice skating rink, and these facilities are not always accessible for ice skating depending on factors such as organized hockey and other private function schedules at the public ice skating rinks. Weather conditions also affect the availability of public ice skating rinks, as inclement weather may temporarily close the ice skating rinks. Public ice skating rinks also may not be proximate or accessible from one's residence. Additionally, the cost of renting ice time is very expensive, with limited availability times. Many of the availability times being either very early in the morning or very late at night, inconvenient for most people, especially those with little children or a busy work schedule.

Issues also arose with the portable ice skating rink. Originally, portable ice skating rinks were made of wood, which made them difficult to assemble, cumbersome, took up a lot of storage space, limited design creativity and were expensive to maintain as a person would need to regularly replace the wood from one year to the next. Then came portable ice skating rinks that used long plastic tubing, such as PVC piping with elbow joints. Once again the portable ice skating rink was cumbersome, took up a lot of storage space, had limited design creativity and were expensive to purchase and maintain all the required components. Other portable ice skating rinks have added on or modified previous portable ice skating rinks by varying or adding such elements as: 4"×4" lumber pieces; curb-like structural members, wood beams and bolts; flexible metal; mini boards with triangular back supports; water inflatable tubes; slit corrugated tubes; extruded panels; with various forms of connectors and liners. Each of these variations, add-ons or combinations resulted in portable ice skating rinks to be even more expensive, cumbersome, difficult to assemble, maintain, or caused more damage to the grounds.

Thus, a heretofore unaddressed need exists in the industry to address the aforementioned deficiencies and inadequacies.

SUMMARY

The present disclosure provides a system and method for a portable ice skating rink, which is not expensive, nor cumbersome, nor difficult to assemble or maintain and does not cause damage to the grounds. Traditional portable ice skating rinks have comprised of such variations or combinations such as using lumber pieces and bolts; curb-like structural members such as PVC piping; flexible metal; mini boards with triangular back supports; water inflatable tubes; slit corrugated tubes; extruded panels; all with various forms of connectors and liners. Each of these variations or combinations resulted in the traditional portable ice skating rinks to be more expensive, cumbersome, difficult to assemble or maintain.

Briefly described, in one embodiment is a portable ice skating rink that uses posts, which are placed at locations on a horizontal surface establishing a border of a closed geometric shape. A flexible rubber sheet is unrolled and wrapped around the posts, defining a skating surface area. The flexible sheet is then connected to itself through an interlocking mechanism, thereby forming a sidewall. Sidewall anchor blocks are then placed outside and against the sidewall. The sidewall anchor blocks are then attached to the sidewall using sidewall anchor bolts. The sidewall anchor blocks are then secured to the horizontal surface by placing sidewall anchor pins through the sidewall anchor blocks into the horizontal surface. The posts are then removed and a flexible waterproof slip is placed onto the horizontal surface over the closed geometric shape and extending outwardly over the sidewall, thereby forming a liner. Liner clips are used to secure the liner to the sidewall. Posts are then placed at locations on the horizontal surface outside and against the sidewall in-between the sidewall anchor blocks to provide additional support to the sidewall. A liquid is then placed within the liner and frozen, creating a skating surface, wherein a person could do such activities as ice skating.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
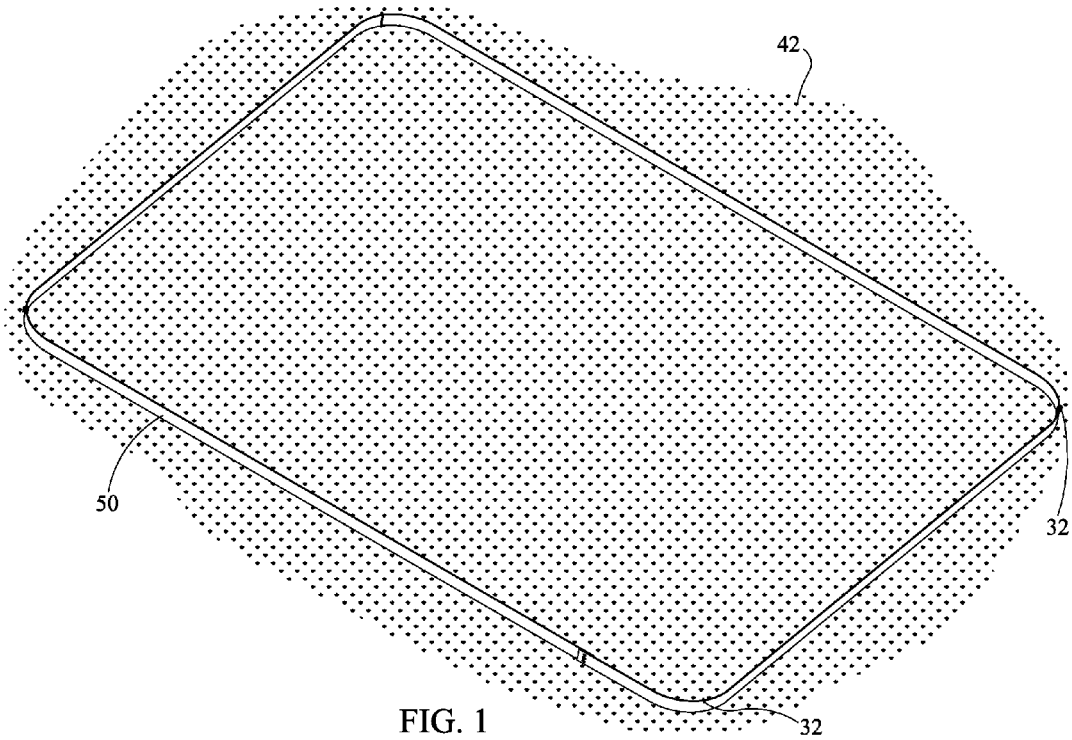
FIG. 1 is a perspective view illustrating the placement of posts and wrapping a flexible rubber sheet around the posts, thus creating a sidewall.

Reference is now made in detail to the description of the embodiments as illustrated in the drawings. While several embodiments are described in the connection with these drawings, there is no intent to limit the disclosure to the embodiment or embodiments disclosed herein. On the contrary, the intent is to cover all alternatives, modifications, and equivalents.

It should be clearly understood that like reference numerals are intended to identify the same structural elements, portions, or surfaces consistently through out the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Currently, it is known that ice skating is a popular recreational activity, and there are many variations of activities that can be engaged on ice skating rinks. Some of the primary activities engaged on ice rinks are recreational ice skating, the games of hockey, curling, figuring skating, and ice dancing. At one time, these activities were performed on "home" ice skating rinks, which primarily took place on frozen ponds, streams, and other naturally occurring bodies of water. With each of these "home" rinks, there is a real and ever present danger, especially with young children, of death by drowning or overexposure upon falling through ice, which is too thin to bear the load, applied. In order to eliminate the danger of "home" rinks, public ice skating rinks started being developed along with portable ice skating rinks. Issues soon arose though with both public ice skating rinks and portable ice skating rinks.

Public ice skating rinks for the general public typically require that a person or family travel either a short distance or a significant distance to arrive at the public ice skating rinks. Once the person or family arrives at the public ice skating rink it is not a guarantee that the person or family will be able to have access as the ice skating rink may be overcrowded, or being used by organized hockey leagues or other private function schedules. Renting or purchasing ice time to guarantee use is not practical as ice time is very expensive with limited choices in regards to availability, which are typically inconvenient for most people.

Prior portable ice skating rinks also have numerous issues, one being they are bulky as they are typically built of either wood or plastic tubing such as PVC piping with either numerous bolts or connectors. In addition, the prior portable ice rinks are expensive, as they require a user to purchase numerous components, which need to be replaced regularly, making the prior portable ice skating rinks also difficult to maintain. Furthermore, the prior portable ice skating rinks are difficult to assemble because of its bulkiness and numerous components, requiring several people to assist in constructing the prior portable ice skating rinks. Lastly, the prior portable ice skating rinks restrict the type of shape the ice skating rink can be to either a square or rectangle based on the material required to build the prior portable ice skating rinks. Thus, there is a need for a portable ice skating rink wherein the above deficiencies and other deficiencies in the prior art have been obviated in a novel manner by the present claimed invention, as will be more apparent upon studying the remaining disclosure.

An embodiment of the claimed invention, a system and method for a portable ice skating rink comprising posts, which are placed at locations on a horizontal surface to establish a border of a closed geometric shape. A flexible rubber sheet constructed of an EPDM rubber type material, is unrolled and wrapped around the posts, thus defining a skating surface area. The flexible rubber sheet is then secured to itself through the use of an interlocking mechanism, thereby forming a sidewall. Sidewall anchor blocks are then placed outside of the sidewall and secured to the sidewall at placement holes located on the sidewall by sidewall anchor bolts, with the sidewall anchor bolts comprising of a bolt and a nut. The sidewall anchor blocks are then secured to the horizontal surface through the use of sidewall anchor pins, which are placed through a hole in the sidewall anchor block into the horizontal surface. The posts are then removed and a flexible, water-proof slip is placed on the horizontal surface over the closed geometric shape, extending beyond the sidewalls, thereby forming a liner of a structure capable of containing a liquid. Liner clips are then used to secure the liner to the sidewall. The posts then may be placed at locations on the horizontal surface outside and against the sidewall in-between the sidewall anchor blocks. The posts provide for added support in keeping the sidewall upright and preventing the sidewall from buckling during the ice making process. Liquid is then placed within the liner during sub-freezing climate allowing the liquid to freeze solid creating a skating surface.

Figure 3:
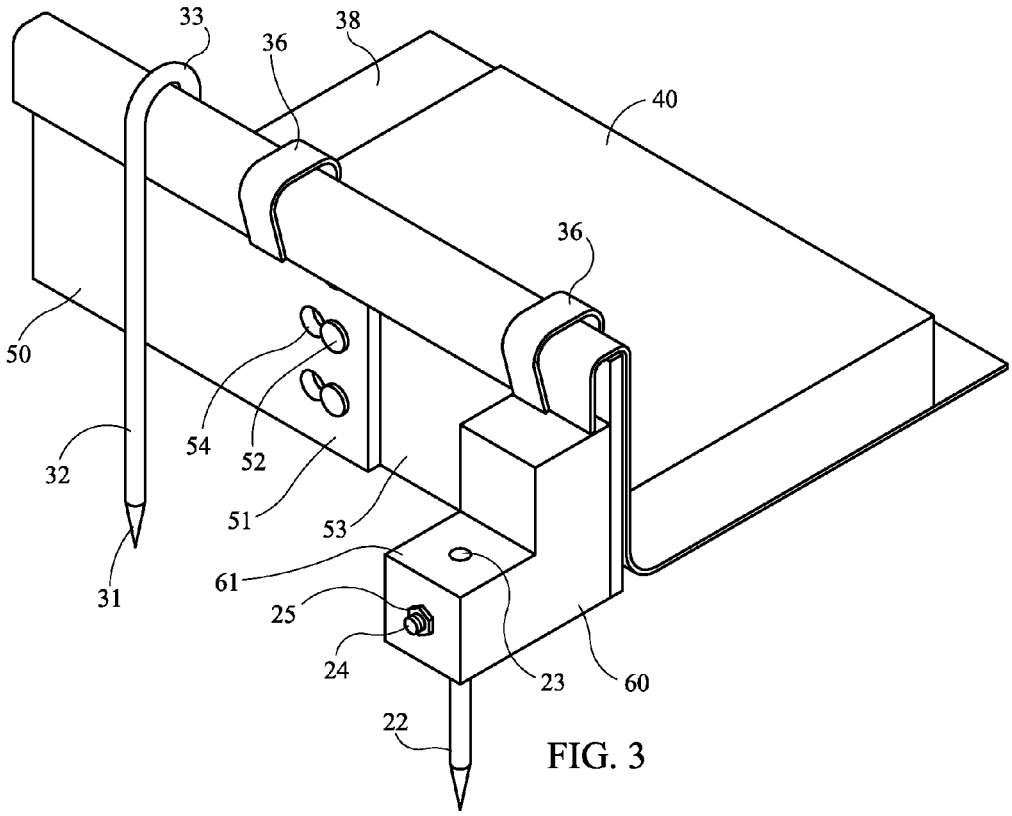
FIG. 3 illustrates a cross-section view taken along line 3-3 of FIG. 2, showing the assembly of a portable ice skating rink.
Figure 4:
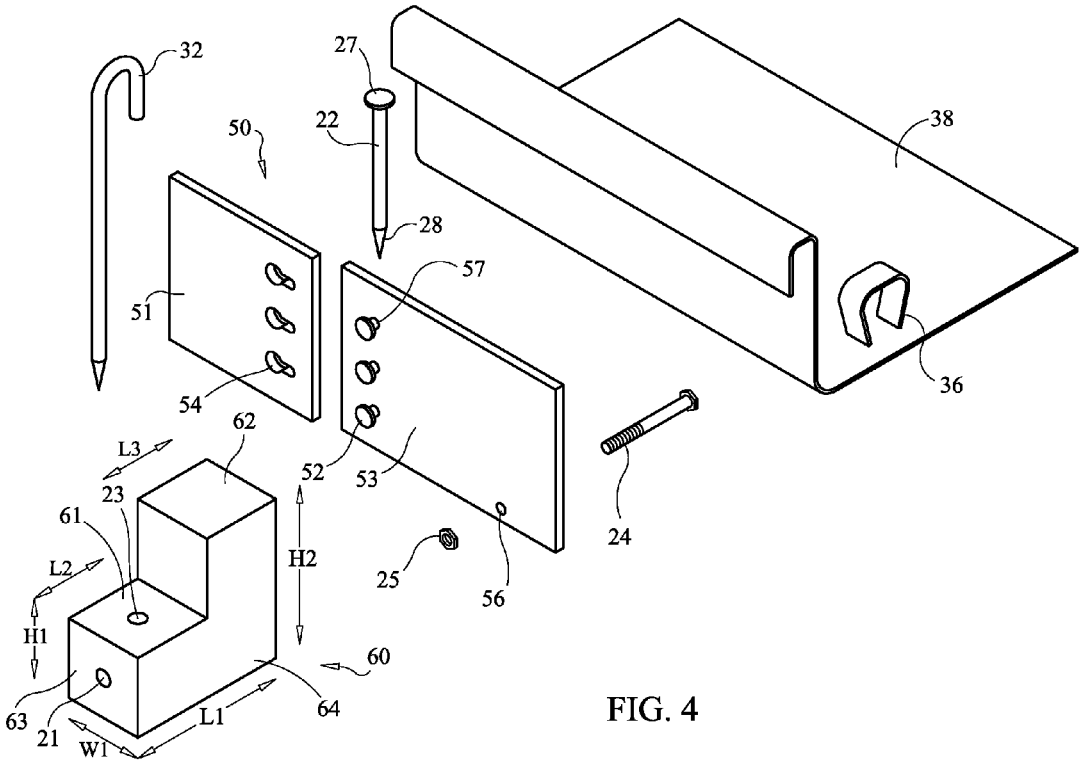
FIG. 4 illustrates an exploded cross sectional view of FIG. 3 further showing the components of a portable ice skating rink.

Adverting now to the drawings, with reference to FIG. 1 shows an initial frame of a portable ice skating rink generally comprising of posts 32, placed at locations on a horizontal surface 42 to establish a border of a closed geometric shape, wherein a flexible rubber sheet 50 having a first end 51 (as shown in FIGS. 3 & 4) and a second end 53 (as shown in FIGS. 3 & 4) is unrolled and wrapped around the posts 32, thereby defining a skating surface area 40 (as shown in FIG. 1). The first end 51 of the flexible rubber sheet 50 is connected to the second end 53 of the flexible rubber sheet 50, either through the use of an interlocking mechanism 54, 52 as shown in FIGS. 3 & 4 or with nuts and bolts (not shown), thereby forming a sidewall 50.

The posts 32 may be placed into the horizontal surface either by hammering or other well-known techniques available to those of ordinary skill in the art. The number of posts 32 can range from at least three to form a triangular ice skating rink to as many as a user needs to form the geometric shape they desire such as a square, rectangle, oval, circle, kidney, free form, and the like. The preferred distance between the posts 32 varies depending on the shape and size of the geometric shape, with the smaller or less sophisticated geometric shapes requiring less posts 32 and larger or more sophisticated geometric shapes requiring more posts 32. The posts 32 may also be interchangeable with a sidewall anchor pin 22 at this point in constructing the portable ice skating rink 10.

The flexible rubber sheet 50 may be constructed of an EPDM rubber type material or other well-known rubber type of material available to those of ordinary skill in the art. The flexible rubber sheet 50 may come in 100-foot rolls, which allow for easy assembling as the flexible rubber sheet 50 only needs to be unrolled and then wrapped around the posts 32. The flexible rubber sheet 50 also allows for easy storage, taking up minimum space, as upon dismantling the portable ice skating rink 10, the flexible rubber sheet 50 may be rolled up and placed with the other elements of the claimed invention within a 30 gallon tote, a garbage can or the like and stored in the corner of a basement, garage or the like.

Figure 2:
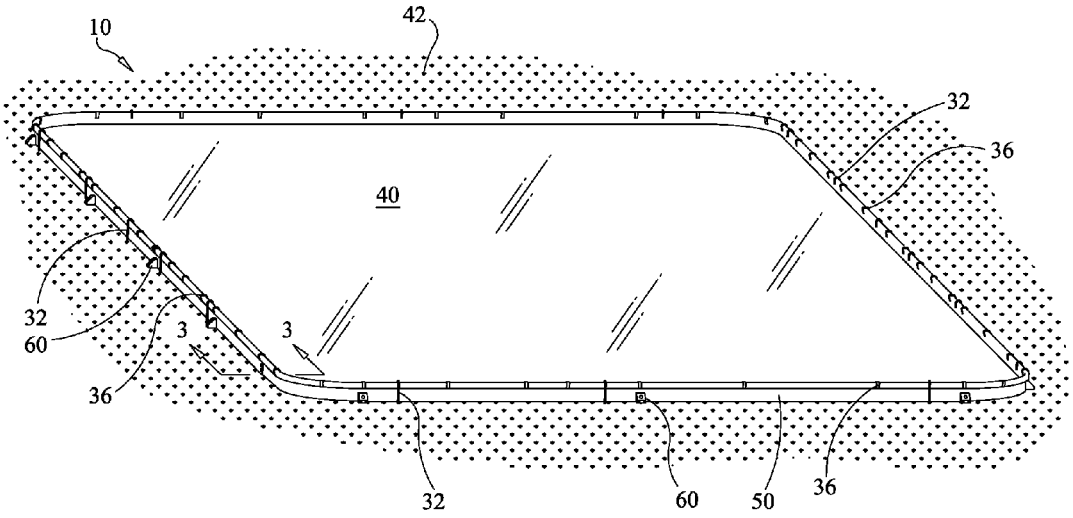
FIG. 2 is a perspective view illustrating an assembled portable ice skating rink in accordance with the claimed invention.

FIG. 2 shows a preferred embodiment of the portable ice skating rink of the present claimed invention as indicated generally by numeral 10 is generally comprised of posts 32, placed at locations on the horizontal surface 42 to establish a border of a closed geometric shape. The flexible rubber sheet 50 having first and second ends 51, 53 (as shown ins FIGS. 3 & 4) is then unrolled and wrapped around the posts 32, therefore defining the skating surface area 40. The first end 51 and the second end 53 of the flexible rubber sheet 50 are connected either through the use of the interlocking mechanism 52, 54 as shown in FIGS. 3 & 4 which will be described hereinbelow, or using a nut and bolt configuration (not shown) wherein a hole, preferably three holes are located at each end 51, 53 of the flexible rubber sheet 50. The holes are large enough to receive the bolt but not so large as to allow the bolt to pass completely through, and the nut is secured onto the bolt, thus securing the flexible rubber sheet 50 to itself, wherein the sidewall 50 is formed (hereinafter flexible rubber sheet will be referred to as "sidewall").

Sidewall anchor blocks 60 may be positioned at a location on the horizontal surface 42 outside and against the sidewall 50 at placement holes 56 located on the sidewall 50 as shown in FIG. 4. The sidewall 50 is affixed to the sidewall anchor block 60 with sidewall anchor bolts 24 & 25 as shown in FIG. 3. A sidewall anchor pin 22 is placed through a hole 23 in the sidewall anchor block 60 as shown in FIG. 3, securing the sidewall anchor block 60 to the horizontal surface 42. The posts 32 are removed from the skating surface area 40 and a flexible, water-proof slip 38 is placed on the horizontal surface 42 over the closed geometric shape extending outwardly over the sidewalls 50, thereby forming a liner 38 of a structure capable of containing a liquid. The liner 38 is secured to the sidewall 50 with a liner clip 36. The posts 32 may be placed at locations on the horizontal surface 42 outside and against the sidewall 50 in-between the sidewall anchor blocks 20. The posts 32 provide for added support in keeping the sidewall 50 upright and preventing the sidewall 50 from buckling when building the ice for the skating surface area 40.

Having completed assembling the portable ice rink 10, the ice building process is ready to begin weather permitting.

Ambient temperatures must be below freezing to effectively build the skating surface area 40, usually requiring close observance of local weather forecasts. Mother Nature's freezing process always commences from the top of the ice and works downward. Thus, rather than filling the liner 38 completely with water, it is preferred to build the skating surface area 40 like the professional . . . a layer at a time. Such a practice eliminates "shell ice" and air entrapment beneath the ice surface, and facilitates regulation of the water to be added so that the existing outdoor temperatures can handle the heat load of the newly applied water in a timely manner. Capitalizing on very cold or night weather during the building process will speed formation of the skating surface area 40. It is recommended that the ice building process be continued until the ice thickness reaches four to six inches or till the ice thickness reaches the top of the sidewall 50. However, the user may fill the liner 38 completely with water till it reaches the desired thickness and allow the skating surface area 40 to freeze solid creating a skating surface 40.

FIG. 3 shows a cross sectional view of the preferred embodiment of the claimed invention, taken generally along line 3-3 in FIG. 2 of the portable ice skating rink 10 illustrating sidewall anchor block 60 positioned to the outside and against the sidewall 50. The sidewall anchor block 60 is affixed to the sidewall 50 with sidewall anchor bolts 24 & 25, which are screwed into the bottom of the sidewall 50 and the sidewall anchor block 60.

The sidewall anchor block 60 may have a first top surface 61 and located on the first top surface 61 may be a hole 23. The sidewall anchor block 60 is secured to the horizontal surface 42 by sidewall anchor pins 22, which are placed through the hole 23 of the sidewall anchor block 60 into the horizontal surface 42.

The sidewall 50 has first end 51 and second end 53 and the ends 51, 53 may be connected through the use of an interlocking mechanism 52 & 54. The interlocking mechanism comprises a male connector 52 as part of the second end 53 and a female connector 54 as part of the first end 51. The connectors 52, 54 may also comprise a shape including rounded lobe-shaped connectors, dovetail connectors and polygonal geometric connectors. Each lobed shaped male connector 52 is shaped to fit into the female connector 54, thereby interlocking the sidewall 50. The female connector 54 has a hole or a throat, which is capable of receiving the male connector 52. The throat may be of the shape of a teardrop, which narrows to interlock with a narrow neck 57 (as shown in FIG. 4) on the male connector 52 to lock the sidewall 50 securely together. If desired the male 52 and female 54 connectors can be made with a slight interference fit with one another or with molded in detents to form an even more secure attachment between the sidewall 50. The connectors 52, 54 may be virtually any geometric shape, diamond, triangle hexagon, they could even be curved or irregularly shaped as long as the connectors are allowed sufficient clearance to interlock.

The flexible, water-proof slip 38 is placed on the horizontal surface 42 (as shown in FIG. 2) over the closed geometric shape extending outwardly over the sidewalls 50, thereby forming the liner 38 capable of containing a liquid. The liner 38 is secured to the sidewall 50 with liner clips 36.

The post 32 may comprise of a first end 31 and a second end 33. The first end shaped as a pin or a cuneated or wedge-shaped point, capable of penetrating the horizontal surface 42. The second end 33 is shaped to have a hooked head of which projects so as to overhang and be capable of affixing itself over the liner 38 and the sidewall 50. The post 32 may be placed at locations on the horizontal surface 42 outside and against the sidewall 50, with the hook 33 facing inward toward the skating surface area 40. The post 32 provides additional support to the sidewall 50 preventing the sidewall 50 from buckling during the ice building process as described above in FIG. 2.

FIG. 4 shows an exploded cross sectional view of FIG. 3 further showing the components of the portable ice skating rink 10 illustrating the sidewall anchor block 60, which may comprise of a single block having a front surface 63, a first side surface 64 and a second side surface (not shown). The sidewall anchor block 60 may also have first top surface 61, a second top surface 62, a bottom surface (not shown), and a rear surface (not shown). The first top surface 61 may have hole 23 located in the center of the first top surface 61, wherein the hole 23 may be capable of receiving sidewall anchor pins 22. In addition, the sidewall anchor block 60 has at least one small hole 21 located approximately to the bottom of the front surface 63, wherein the small hole 21 is capable of receiving sidewall anchor bolt 24. In an alternate embodiment the sidewall anchor blocks 60 may comprise of multiple blocks, wherein they may be configured of a first member and a second member, with the first member and the second member being generally rectangular. The two members are preferably joined at a right angle with, the first member being affixed to the rear of the second member in the center of the second member. In another embodiment the sidewall anchor block 60 comprises of a third member along with the first member and the second member. The members being generally of a square shape with the first member and the second member being joined together to form a generally rectangular shape and the third member being placed on top of the first member or second member to form an L-Shape as in FIGS. 3 & 4. The sidewall anchor blocks 60 may be manufactured and comprise of such material such as wood, metal (preferably covered by plastic coating) such as aluminum or steel, or preferably recycled rubber material or hard injection molded plastic such as polyethylene, polypropylene, poly (acrylonitrile-butadiene-styrene) known as ABS, polyester, polyamide or mixtures of such plastic, with or without glass reinforcement, or combination of such materials. The sidewall anchor blocks 60 are preferably formed, cut and drilled into block shapes as shown in FIGS. 3 & 4. The preferred dimensions of the sidewall anchor blocks 60 are a length L1 of 8 inches, L2 of 4 inches, and L3 of 4 inches; a width W1 of 6 inches; and a height of H1 of 4 inches, and H2 of 8 inches. However, the size of the sidewall anchor blocks 20 may be of smaller or larger proportion to support various shaped portable ice-skating rinks 10.

The sidewall anchor pins 22 are preferable constructed of steel or other well-known materials available to those of ordinary skill in the art. The sidewall anchor pins 22 have a first end 28 and a second end 27, wherein the first end 28 is of a shape of a pin or a cuneated or wedge-shaped point, capable of penetrating the horizontal surface 42. The second end 27 is preferably a flat circular head. The preferred length of the sidewall anchor pins 22 are eight to ten inches, and 1/16 inch diameter but may be of other lengths and diameters dependent on the users requirements as larger sidewall anchor pins 22 may be needed based on the size of the sidewall anchor blocks 60 or the type of horizontal surface 42.

The sidewall anchor bolts 24 and 25, are preferably a standard bolt 24 with a length of seven to eight inches and 1/8 inch thick with a fitting nut 25 of the appropriate size to fit the thickness of the bolt 24. The sidewall anchor bolts 24 and 25 may be larger or smaller depending if the user is using either larger or smaller sidewall anchor blocks 60 or thicker or thinner flexible rubber sheet 50.

The posts 32 may be made of steel or other well-known sturdy materials available to those of ordinary skill in the art. The length of the posts 32 are preferably sixteen inches, but may vary in size depending on users choice of flexible rubber sheet 50.

The flexible rubber sheet 50 or also known throughout the claimed invention as the sidewall 50 and may be constructed of an EPDM rubber type material or other well-known rubber type of materials available to those of ordinary skill in the art. The dimensions of the flexible rubber sheet 50 is preferably twelve inches in height and a thickness of 1/8 inch to 1/16 inch and the length may vary depending on the size of the desired playing area as defined by the user. The sidewalls 50 may be stored and packaged in fifty-foot sections and in tightly compacted rolls. The flexible rubber sheet 50 may also have placement holes 56 located preferably every two to three feet, three inches from the bottom of the sidewall 50. The placement holes 56 are capable of receiving sidewall anchor bolts 24. The flexible rubber sheet 50 may also have the interlocking mechanism 52, 54 as described above in FIG. 3 or it may have numerous holes preferably three located at the first end 51 and second end 53 of the flexible rubber sheet 50, where currently the interlocking mechanism 52, 54 is located. These holes in the flexible rubber sheet 50 are of the size capable of receiving a standard size bolt, which is thread through the holes and a nut is connected to the bolt securing the two ends 51, 53 of the flexible rubber sheet 50.

The flexible, water-proof slip 38 or also known throughout the claimed invention as the liner 38 may be constructed of a water impermeable barrier such as Tyvek type material, vinyl tarp type material, or elastomers such as polybutadiene, polyisoprene, natural rubber, poly(butadiene-styrene), poly(butadiene-acrylonitrile), polyurethane, poly(ethylene-propylene) or poly(ethylene-propylene-non-conjugated diene) and the like, or fabric coated with such elastomers or with the above mentioned plastics, or other well-known water impermeable barriers available to those of ordinary skill in the art. The liner 38 may very in size depending on the size of the desired skating surface area 40 defined by the user.

The liner clips 36 are preferably an aluminum clip or other well-known materials available to those of ordinary skill in the art. The preferred size of the liner clips 36 is of the size of one to two inches. However, the size of the liner clip 36 may vary depending on the thickness of the flexible rubber sheet 50 and the flexible, water-proof slip 38.

When setting up the portable ice skating rink of the claimed invention it is advisable to seek a substantially leveled ground or surface, free of any debris. The method of the claimed invention comprises of: first, placing posts 32 at locations on the horizontal surface 42 to establish a border of a closed geometric shape. Next, the flexible rubber sheet 50 having first and second ends 51, 53 is unrolled and then wrapped around the posts 32 thereby defining the skating surface area 40. The first end 51 of the flexible rubber sheet 50 is connect to the second end 53 of the flexible rubber sheet 50 by the interlocking mechanism 52, 54 or with nuts and bolts, thereby forming a sidewall 50. Sidewall anchor blocks 60 are then placed against the outside of the sidewall 50 and the skating surface area 40. The sidewall anchor blocks 60 are then secured to the sidewall 50 at placement holes 56 located on the sidewall 50 with sidewall anchor bolts 24, with the sidewall anchor bolts 24 comprising of bolts 24 and nuts 25. Sidewall anchor pins 22 are then placed through the hole 23 located on the first top surface 61 of the sidewall anchor block 60, thus securing the sidewall anchor blocks 60 to the horizontal surface 42. The posts 32 are then removed from the skating surface area 40. The flexible, water-proof slip 38 is then placed on the horizontal surface 42 over the closed geometric shape and extending beyond the sidewalls 50, thereby forming the liner 38 of the portable ice skating rink 10 capable of containing liquid. Liner clips are then used to secure the liner 38 to the sidewall 50. The liquid is then placed within the liner 38 during below freezing temperatures, thereby freezing the liquid and creating the skating surface 40.

Although exemplary embodiments have been shown and described, it will be clear to those of ordinary skill in the art that a number of changes, modifications, or alterations to the disclosure as described may be made. For example, the sidewall anchor blocks may comprise of a sloped surface and located on the sloped surface a hole capable of receiving sidewall anchor pins. In addition, the sidewall anchor block may have small holes located approximately to the bottom of the sidewall anchor block capable of receiving sidewall anchor bolts and the sidewall anchor block may be constructed of wood. In addition bands may be placed in-between the ice sheets to create lines such as those on a hockey rink. All such changes, modifications, and alterations should therefore be seen as within the scope of the disclosure.

What is claimed is:

1. A portable ice skating rink comprising:

a flexible rubber sheet having a first end and a second end wherein the first end is connected to the second end thereby forming a sidewall, wherein the sidewall is positioned on a horizontal surface to form the border of a closed geometric shape thereby defining a skating surface area, and a flexible, waterproof slip draped over and connected to the sidewalls, thereby forming a liner of a structure capable of containing a liquid inward of the sidewalls to create a skating surface, wherein the liner is connected to the sidewall with a liner clip.

2. The portable ice skating rink of claim 1, wherein a sidewall anchor block is attached to the sidewall and secured to the horizontal surface.

3. The portable ice skating rink of claim 2, wherein the sidewall anchor block is attached to the sidewall by sidewall anchor bolts.

4. The portable ice skating rink of claim 1, wherein an interlocking mechanism having at least one connector, the connector being selected from the group consisting of a male connector and a female connector, the male connector being a projection from the flexible rubber sheet located at either the first end or the second end of the flexible rubber sheet, the female connector being a hole located at the opposite end of which the male connector is located on the flexible rubber sheet.

5. The portable ice skating rink of claim 4, wherein the projection of the male connector has a narrow neck connecting the projection to the flexible rubber sheet and the hole of the female connector has a narrow throat.

6. The portable ice skating rink of claim 1, further comprising placement holes capable of receiving the sidewall anchor bolt, wherein the placement holes are located proximate the bottom of the sidewall.

7. The portable ice skating rink of claim 1, wherein the sidewall anchor block has a small hole capable of receiving the sidewall anchor bolt located proximate to the bottom of the sidewall anchor block.

8. The portable ice skating rink of claim 7, wherein, the sidewall anchor block is L-Shaped having a first front face, a first side face, a second side face, a rear face, a bottom face, a first top surface and a second top surface.

9. The portable ice skating rink of claim 8, wherein a hole for receiving a sidewall anchor pin is located on the first top surface of the sidewall anchor block.

10. The portable ice skating rink of claim 1, wherein a sidewall anchor pin has a first end and a second end, the first end is operatively arranged to penetrate the horizontal surface and attached to the second end of the sidewall anchor pin is a circular flat head.

11. The portable ice skating rink of claim 1, wherein a post has a first end and a second end, the first end having a shape of a pin capable of penetrating the horizontal surface, the second end having a shape of a hook.

12. The portable ice skating rink of claim 11, wherein the hook of the second end of the post is capable of attaching to the sidewall and liner.

13. The portable ice skating rink of claim 1, wherein an interlocking mechanism of the sidewall comprises holes capable of receiving a bolt.

14. A method of assembling a portable ice skating link, the method comprising the steps of:

placing posts at locations on a horizontal surface to establish a border of a closed geometric shape;

wrapping a flexible rubber sheet baying a first end and a second end around the posts thereby defining a skating surface area;

connecting the first end of the flexible rubber sheet to the second end of the flexible rubber sheet thereby forming a sidewall;

placing sidewall anchor blocks against the outside of the sidewall;

securing the sidewall anchor blocks to the sidewall;

securing the sidewall anchor blocks to the horizontal surface;

removing the posts from the skating surface area;

placing a flexible, water-proof slip on said horizontal surface over the closed geometric shape and extending beyond the sidewalls, thereby forming a liner of a structure capable of containing a liquid;

securing the liner to the sidewall;

placing the posts against the outside of said sidewall;

placing a liquid within the structure; and freezing the liquid to create a skating surface.

15. The method of claim 14, further comprising the step of using an interlocking mechanism to connect the first end of the flexible rubber sheet to the second end of the flexible rubber sheet.

16. The method of claim 14, further comprising the step of using bolts and nuts to connect the first end of the flexible rubber sheet to the second end of the flexible rubber sheet.

17. The method of claim 14, further comprising the step of using sidewall anchor bolts placed through a placement hole located proximate the bottom of the sidewall and through a small hole located approximately to the bottom of a front surface and rear surface of the sidewall anchor block, thereby securing the sidewall anchor block to the sidewall.

18. The method of claim 14, further comprising the step of placing a sidewall anchor pin through a bole located on a first top surface of the sidewall anchor block, thereby securing the sidewall anchor block to the horizontal surface.

19. A portable ice skating rink comprising:

a flexible rubber sheet having a first end and a second end wherein the first end is connected to the second end thereby forming a sidewall, wherein the sidewall is positioned on a horizontal surface to form the border of a closed geometric shape thereby defining a skating surface area, and a flexible, waterproof slip draped over and connected to the sidewalls, thereby forming a liner of a structure capable of containing a liquid inward of the sidewalls to create a skating surface, wherein a sidewall anchor pin has a first end and a second end, the first end is operatively arranged to penetrate the horizontal surface and attached to the second end of the sidewall anchor pin is a circular flat head.

* * * * *